US006042027A

United States Patent [19]

Sandvik

[11] Patent Number: 6,042,027

[45] Date of Patent: Mar. 28, 2000

[54] SHOWER HEAD

[76] Inventor: Arne Paul Sandvik, 17128 Carranza Dr., San Diego, Calif. 92127

[21] Appl. No.: 09/216,144

[22] Filed: Dec. 18, 1998

[51] Int. Cl.[7] ..... B05B 7/08; B05B 1/32; B05B 15/08; B05B 1/00

[52] U.S. Cl. ..... 239/422; 239/444; 239/549; 4/615

[58] Field of Search ..... 4/601, 568, 570, 4/615; 239/549, 444, 443, 436, 422

[56] References Cited

U.S. PATENT DOCUMENTS 1,733,054 10/1929 Crill ..... 239/549
2,949,240 8/1960 Koolnis ..... 239/549
3,034,138 5/1962 Filliung ..... 4/570
5,311,621 5/1994 Tung ..... 4/615

*Primary Examiner*—Andres Kashnikow
*Assistant Examiner*—Davis Hwu
*Attorney, Agent, or Firm*—Brown, Martin, Haller & McClain, LLP

[57] ABSTRACT

A shower head has an array of spray nozzles arranged over an outlet face. A first set of nozzles is connected to a cold water supply to provide cold water spray nozzles, and a second set of the nozzles is connected to a hot water supply to provide hot water spray nozzles. A third set of nozzles surrounds the hot and cold water nozzles, and is connected to a mixed water supply at a temperature between the hot and cold water temperatures.

15 Claims, 5 Drawing Sheets

SHOWER HEAD

BACKGROUND OF THE INVENTION

The present invention relates generally to shower or spray heads for connection to a water supply to produce a spray of water from a plurality of outlet nozzles in the head.

A basic shower head has a single inlet supply from hot and cold water sources, which are mixed to produce the desired water temperature. Variations on this standard shower or spray head have been proposed in the past, for example oscillating or pulsating shower heads which produce a pulsating outlet spray, providing a "massage" sensation to the user's skin.

It has, in the past, been considered to be invigorating and stimulating to switch temperatures, say from hot to cold, when bathing, for example moving from a hot bath or sauna to a cold shower. My prior U.S. Pat. No. 4,801,091 is directed to a pulsating hot and cold shower head which provides alternating pulses of hot and cold water. Although this does have an invigorating effect, most pulsating shower heads are relatively complex in design and involve internal moving parts which are liable to malfunction due to build up of minerals from the water in the internal rotor. If the shower head should freeze during operation, the user may be surprised with a sudden change in operating temperature. Therefore, it would be advantageous to provide an equivalent stimulating effect in a shower head without requiring internal moving parts.

U.S. Pat. No. 2,949,109 of Koolnis describes a therapeutic shower in which a first set of parallel spray tubes are connected to a hot water supply and a second set of parallel spray tubes are connected to a cold water supply. The two sets of spray tubes are assembled as a unit in adjacent pipe layers so that combined hot and cold jet sprays are directed onto the user.

SUMMARY OF THE INVENTION

The present invention relates generally to shower or spray heads for connection to a water supply to produce a spray of water from a plurality of outlet nozzles in the head.

According to one aspect of the present invention, a shower head is provided which comprises a hollow outer housing having an outlet face, an array of hot water and cold water nozzles arranged over the outlet face, a hot water and cold water inlet connected to the hot water and cold water nozzles, respectively, and the hot and cold water nozzles alternating across the outlet face of the shower head.

In a preferred embodiment of the invention, the shower head outlet face also has mixed water nozzles and a mixed water inlet connected to the mixed water nozzles. Preferably, the mixed water nozzles are arranged around the perimeter of the outlet face, with the alternating hot and cold nozzles within the area surrounded by the mixed water nozzles. This provides outlet sprays at three different temperatures, with hot and cold water separated so that the user can feel the physical sensation of two different temperatures within the overall water spray, while having a mixed temperature sprayed onto their body from the mixed nozzles to make it easier to step into the shower.

Preferably, each spray nozzle is adjustable from a very straight, thin spray to a cone-shaped spray which will intersect with adjacent sprays. Thus, the user may selectively adjust all the sprays to be thin and non-diverging, so that the screams do not intersect and the user can feel the temperature difference between the streams. Alternatively, the sprays may be adjusted to diverge slightly so that the user feels a different effect depending on whether they are close to the head or farther away, where the sprays intersect.

A valve assembly is preferably provided for controlling the temperature at the mixed spray nozzles and for controlling the amount of water supplied to the hot, cold and mixed spray nozzles. First and second passageways are connected to the hot and cold inlets for supplying hot and cold water, respectively, to those inlets. Third and fourth passageways connect the first and second passageways to the mixed water inlet. First, second, third, and fourth valves are located in the first, second, third, and fourth passageways, respectively. Adjustment of the first and second valves with the third and fourth valves completely open controls the temperature of water at the mixed water inlet. If the amount of water supplied to the hot and cold spray nozzles is to be varied, the user simply adjusts the settings of the third and fourth valves. For example, for more hot water than cold water in the hot and cold nozzles, the fourth valve is left completely open, while the third valve is partially closed. The first and second valves are then adjusted to produce the desired perimeter mixed temperature.

The valve assembly may also be arranged for selectively supplying mixed temperature water to all the nozzles. In this case, fifth and sixth passageways connect the hot and cold water supplies, respectively, to the mixed water inlet, bypassing the first and second valves. Fifth and sixth valves, respectively, are located in the fifth and sixth passageway. If mixed temperature water is to be supplied to all the spray nozzles, the first and second valves are completely closed, and the third and fourth valves are completely open. The fifth and sixth valves are then adjusted to set the temperature of the mixed water flow to all three inlets.

The number and configuration of the spray nozzles may be varied, although there are preferably between 30 and 60 or more spray nozzles in the shower head. The shower head may be mounted in a fixed wall fitting, or may be selectively used as a hand held device. The face of the shower head may be flat, or may alternatively be concave or convex such that the spray streams will converge or diverge, respectively, as they move away from the head.

Existing piping for showers usually mixes the water at two valves located near the bath fixture. Conversion of this system would typically require removal of part of the wall and tile to replace piping and valves. Included here is a means to convert the valving and piping without removing the wall.

According to another aspect of the present invention, a retrofit assembly is provided for providing separate hot and cold inlets to the shower head using existing shower piping which mixes hot and cold water at two valves located near a bath fixture. In a conventional combined bath and shower fixture of the type having only one outlet selectively directing a mixture of hot and cold water into the bath or shower head, two tap controllers are provided for controlling two valves connected to the hot and cold water supplies, respectively. The retrofit assembly comprises a pair of inserts for replacing the existing control valves. Each insert comprises a T-junction having a first outlet connected to a conventional tap outlet, and a second outlet connected to the respective shower head inlet. A valve is provided at the second outlet to control the hot or cold water supply to the respective shower head inlet. With this arrangement, the original single pipe supplying the old shower head can be by-passed, and two separate inlets are instead provided, with the shower head of this invention replacing the old shower head and connected to the separate water supply inlets. This avoids the need for a major retrofit involving removal of part of the existing wall and tile enclosing the bath and shower fixture, and allows the shower head of this invention to be installed relatively cheaply.

The shower head of this invention keeps hot and cold water separate so that the user feels the physical sensation of the two different temperature streams without discomfort, due to the alternating hot and cold nozzle arrangement. By providing mixed flow nozzles around the periphery of the outlet face of the shower head, the user can more readily step into the shower.

BRIEF DESCRIPTION OF THE DRAWINGS

The present invention will be better understood from the following detailed description of some preferred embodiments of the invention, taken in conjunction with the accompanying drawings in which like reference numerals refer to parts and in which.

DESCRIPTION OF THE PREFERRED EMBODIMENTS

Figure 2:
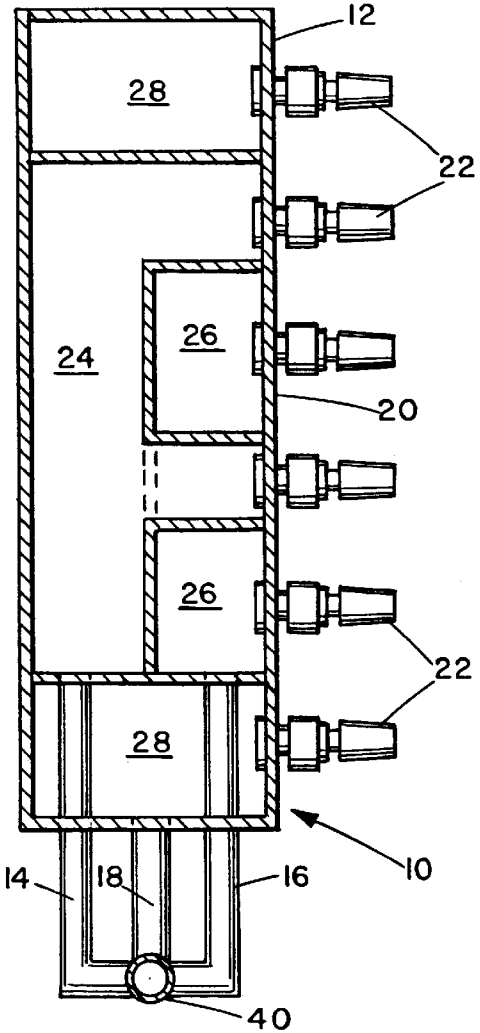
FIG. 2 is a sectional view taken on line 2—2 of FIG. 1.

FIGS. 1 to 4 illustrate a shower head 10 according to a preferred embodiment of the invention which is adapted for installation in a shower or shower and bath fixture. Shower head 10 comprises a hollow outer housing 12 having a hot water inlet 14, a cold water inlet 16, and a mixed water inlet 18. Housing 12 has an outlet face 20 over which an array of spray nozzles 22 are arranged.

Figure 3:
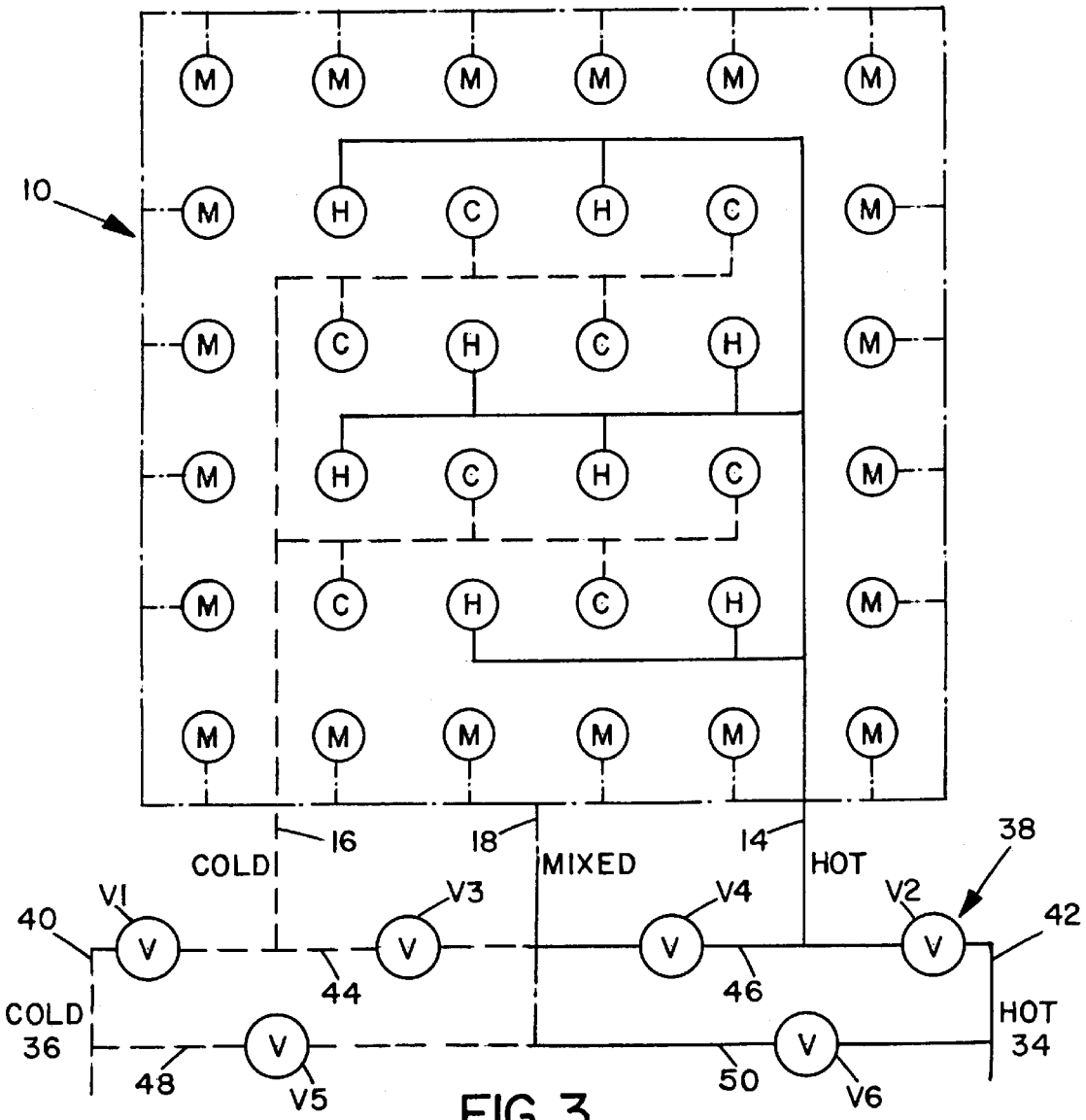
FIG. 3 is a diagram of the water connections and valves, with optional or modified valve arrangements to allow for mixed flow from all nozzles.

The interior of housing 12 is divided into three separate chambers 24, 26, and 28, as best illustrated in FIG. 2. As best illustrated in FIG. 3, the first chamber 24 is connected to the hot water inlet 14 and to a first set of the spray nozzles 22, specifically the nozzles labeled H in FIG. 3. The second chamber 26 is connected to the cold water inlet 16 and a second set of spray nozzles, specifically the nozzles labeled C in FIG. 3. Finally, the third chamber 28 around the periphery of the housing is connected to the mixed water inlet 18 and to a third set of spray nozzles, specifically the nozzles labeled M in FIG. 3. In the preferred arrangement, the mixed water nozzles H are arranged around the outside of the outlet face 20, while the hot and cold nozzles H and C alternate across the central region of face 20.

In the illustrated arrangement 36, nozzles are arranged in a square array over outlet face 20. However, the number and configuration of the nozzles may be varied. For example, the nozzle pattern may alternatively be circular, oval, rectangular, heart-shaped, or the like.

Figure 4:
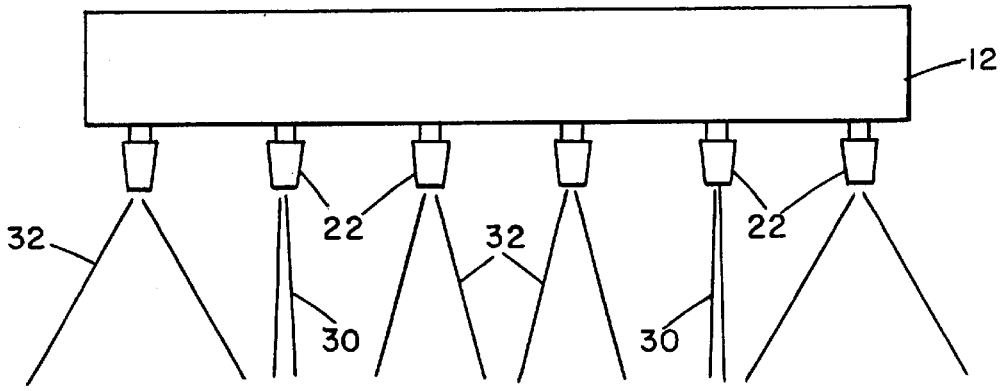
FIG. 4 is a side view of the shower head showing one spray pattern.

Each spray nozzle 22 is preferably adjustable from a straight, thin spray 30 to a cone-shaped spray 32 of various angles, as illustrated in FIG. 4. Any suitable adjustable spray nozzle may be used, such as a Model 5500-PPB-X3 nozzle as manufactured by Spraying Systems Co. of Wheaton, Ill. Preferably, the range of adjustment angle is approximately zero to fifteen degrees, although larger angles may be used in some cases. With this arrangement, the user can adjust between completely separate, spaced spray streams 30 and cone-shaped sprays 32 which will overlap with the adjacent sprays at an adjustable distance from the spray head. If the spray streams are set to diverge slightly, the user will feel a different effect the closer or farther away they are from the shower head. The closer the user stands to the shower head, the more pronounced the temperature difference will be, since the sprays will not yet overlap and mix.

Figure 1:
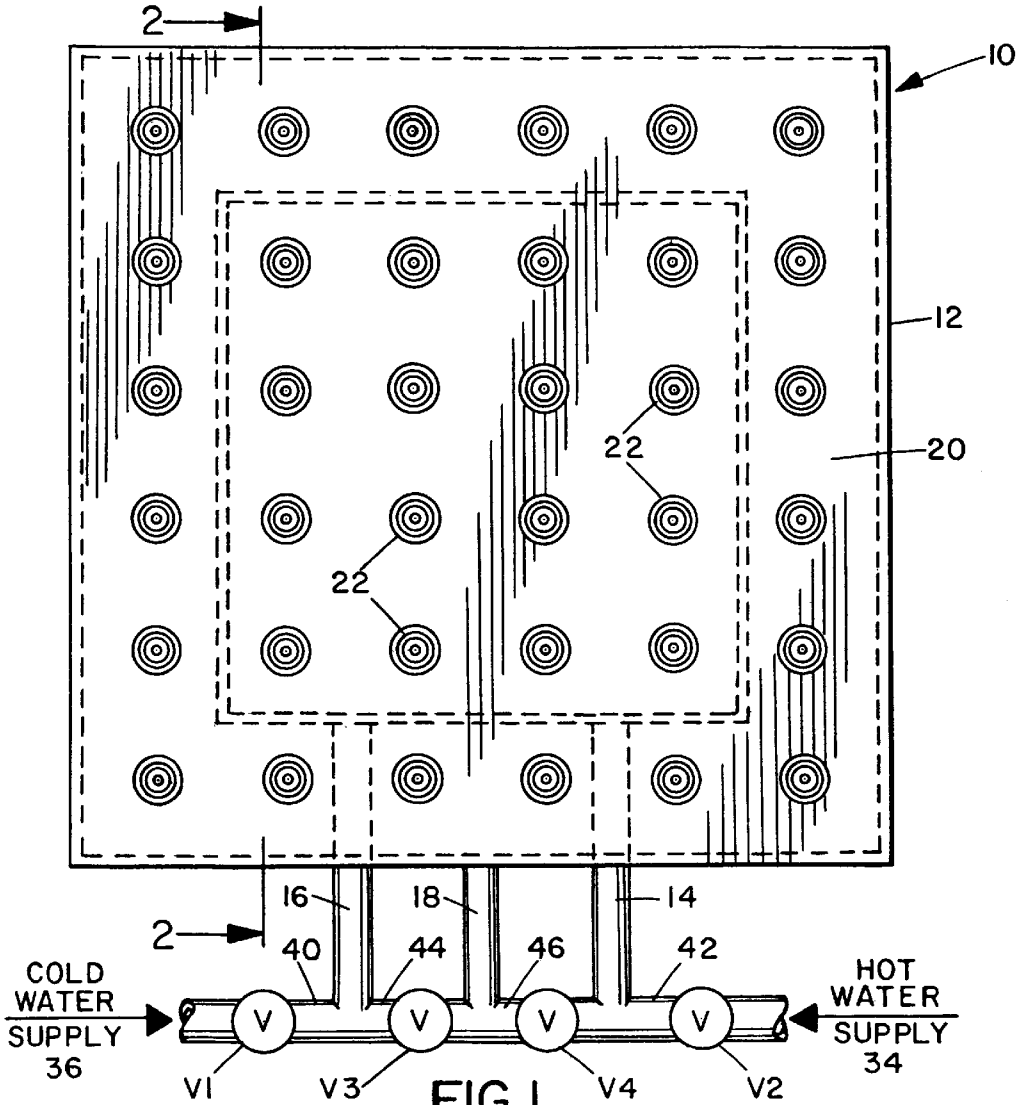
FIG. 1 is a front view of the shower head according to a first embodiment of the invention.

The housing 12 is connected to a source of hot water 34 and cold water 36 via a valve assembly 38, as illustrated in FIGS. 1 and 3. The basic valve assembly comprises four valves: V1, V2, V3 and V4. A first valve V1 is mounted in a first passageway 40 between the cold water supply 36 and cold water inlet 16. The second valve V2 is mounted in a second passageway 42 between hot water supply 34 and hot water inlet 14. The third and fourth valves, V3 and V4, are mounted in third and fourth passageways 44, 46, respectively, between the first passageway and the mixed water inlet 18, and between the second passageway and the mixed water inlet.

The four valves, V1 to V4, are used to set the temperature of the perimeter, mixed nozzles and to adjust the proportion of hot to cold water in the internal nozzles H and C. Two additional valves V5, V6 may be used to switch between the hot/cold operating mode of FIG. 3 and a mixed flow operating mode in which a mixed flow spray is provided at all the spray nozzles. Valve V5 is provided in a fifth passageway 48 between cold water supply 36 and mixed water inlet 18, and valve V6 is provided in sixth passageway 50 between hot water supply 34 and mixed water inlet 18, bypassing valves V1 and V2, respectively.

Operation of valves V1 to V4 with valves V5 and V6 closed (hot/cold operating mode) will first be described. The water temperature at the mixed nozzles M is controlled by adjusting the opening of valves V1 and V2 with valves V3 and V4 fully open. The proportion of hot to cold water in the internal nozzles H and C may be controlled by adjusting the settings of valves V3 and V4. If valves V3 and V4 are fully open, approximately the same overall split in flows and temperatures will be provided on the internal nozzles and perimeter, mixed nozzles. In order to provide more hot than cold water in the internal nozzles, valve V3 is left fully open, diverting half of the cold water to the mixed flow nozzles M, while valve V4 is partially closed, so that more hot water than cold water is dispatched to the nozzles H and C. The arrangement is reversed to dispatch more cold water than hot water to the internal nozzles. Once the valves V3 and V4 have been set as desired, valves V1 and V2 are adjusted to provide the desired temperature at mixed nozzles M.

FIG. 3 also shows one potential configuration to allow the user to switch from a hot/cold-operating mode to a totally mixed flow mode. This is achieved by closing valves V1 and V2, fully opening valves V3 and V4, and adjusting the setting of valves V5 and V6 to control the temperature of the mixed water flow at all of the nozzles 22. In this operating mode, the flow to the mixed inlet 18 will be via passageways 48 and 50 and valves V5 and V6. The flow to the cold water inlet 16 will be via passageways 48, 50 and passageway 44, and the flow to the hot water inlet will be via passageways 48, 50 and passageway 46. Thus, the same basic mixture of hot and cold water will be provided at all of the spray nozzles, at a temperature dependent on the settings of valves VS and V6. In order to change back to the hot/cold-operating mode of FIG. 3, valves V5 and V6 are simply closed, and valves V1 and V2 are set to the desired opening as described above.

Figure 3A:
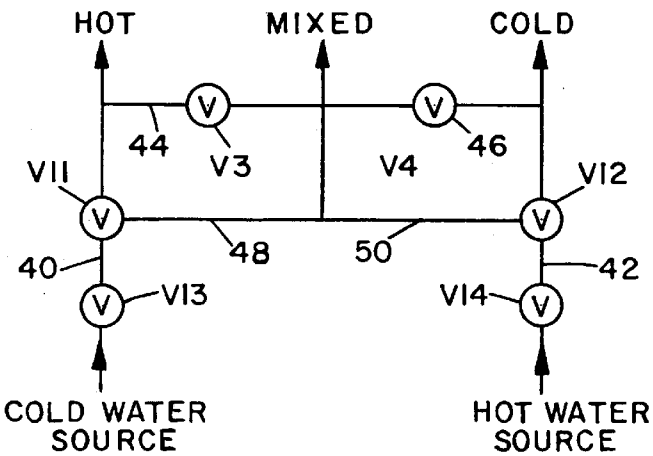
FIG. 3A illustrates another modified valve arrangement.

There are other possible valve arrangements to permit switching between hot/cold and totally mixed operating modes, such as the alternative illustrated in FIG. 3A. In this alternative, valves V1 and V2 are replaced by multi-port or three-way valves V11 and V12 at the junction between passageways 40 and 48, and 42 and 50, respectively, so as to direct cold water and hot water selectively between the cold or hot water inlet and the mixed water inlet. In this case, valves V13 and V14 will be provided between the respective cold and hot water supply and the multi-port valves V11 and V12, respectively. In this case, the user can switch to a totally mixed operating mode by opening valves V11 and V12 to the passageways 48 and 50, respectively, and adjusting the setting of valves V13 and V14 according to the desired operating temperature.

With this arrangement, the user may selectively use the shower head in a hot/cold water mode to achieve the sensation of separate hot and cold water streams on their body, or in a conventional mode in which mixed water sprays at an intermediate temperature are provided from all of the spray nozzles 22.

Figure 5:
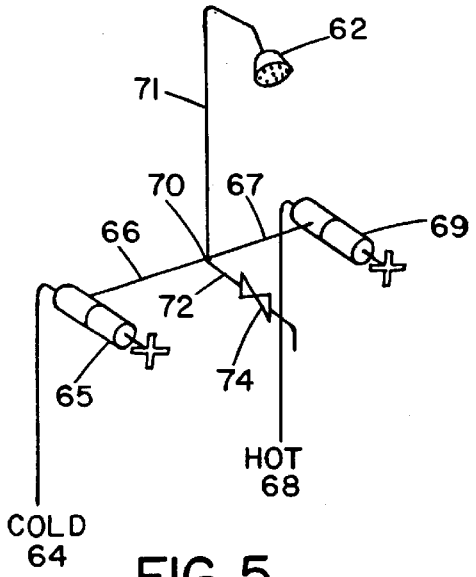
FIG. 5 PRIOR ART
FIG. 5 is a diagram of a typical existing two-valve shower and bath plumbing system.

In order to install the shower head of FIGS. 1 to 4, separate hot and cold water supplies must be provided. This may be a problem in some typical shower or shower/bath installations which do not have separate hot and cold water supplies to the shower head, but only a single, mixed water inlet. One plumbing system of this type for a conventional shower head 62 having separate hot and cold control valves is illustrated in FIG. 5. In this system, cold water supply 64 is connected via control valve 65 to pipe 66, and hot water supply 68 is connected via control valve 69 to pipe 67. Pipes 66 and 67 meet at junction 70. A first passageway or pipe 71 connects junction 70 to the shower head, while passageway 72 connects via valve 74 to an outlet or tap into a bathtub, for example. If valve 74 is open, the combined hot and cold water goes into the bathtub. If valve 74 is closed, the combined hot and cold water goes along pipe 71 to the shower head 62.

Figure 6:
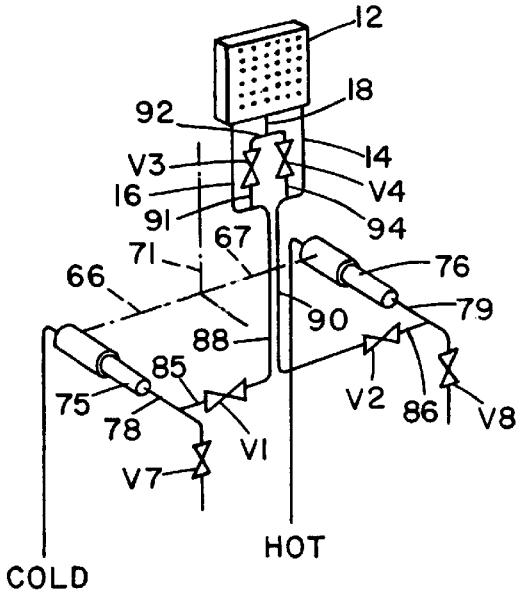
FIG. 6 is a diagram of the system as modified for the present shower head for an existing two-valve system.
Figure 7:
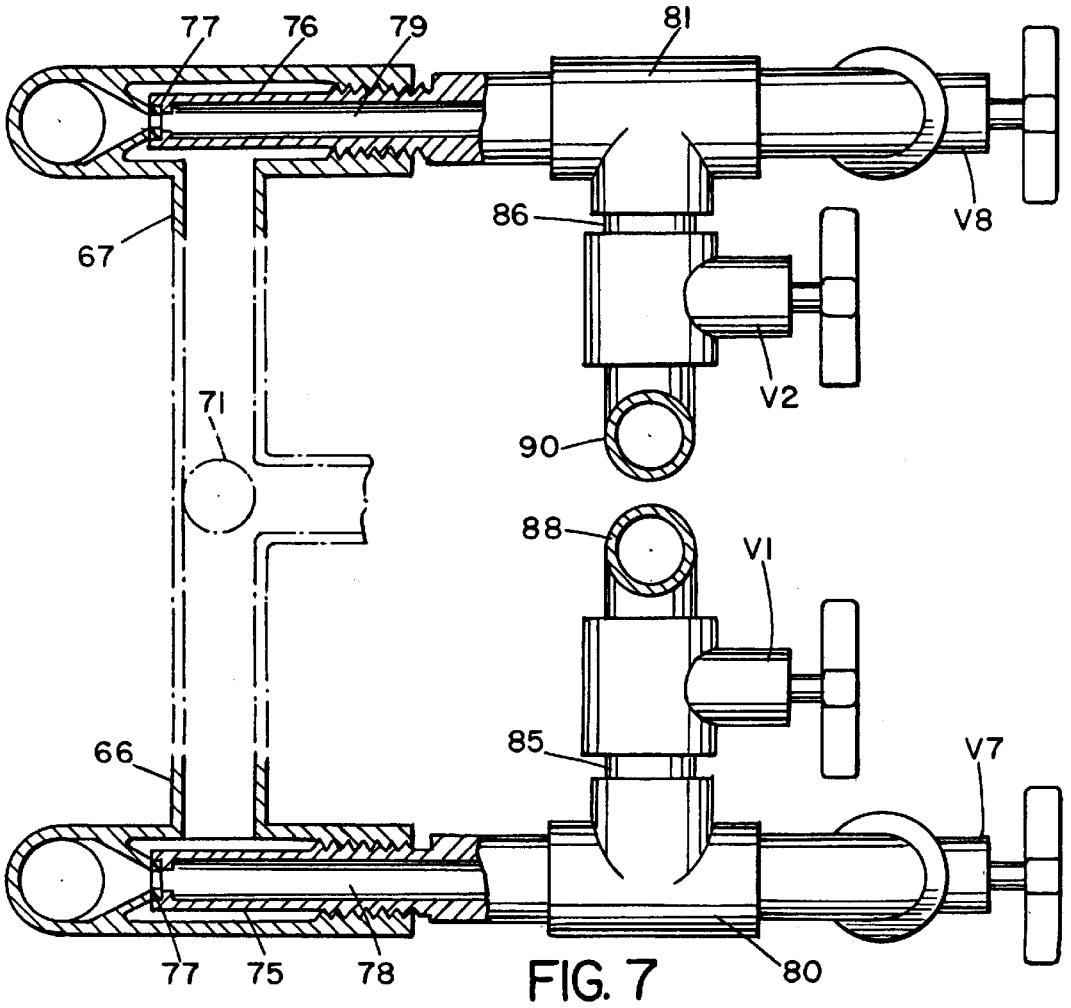
FIG. 7 is a top view of the modified valve assembly, with portions cut away.
Figure 8:
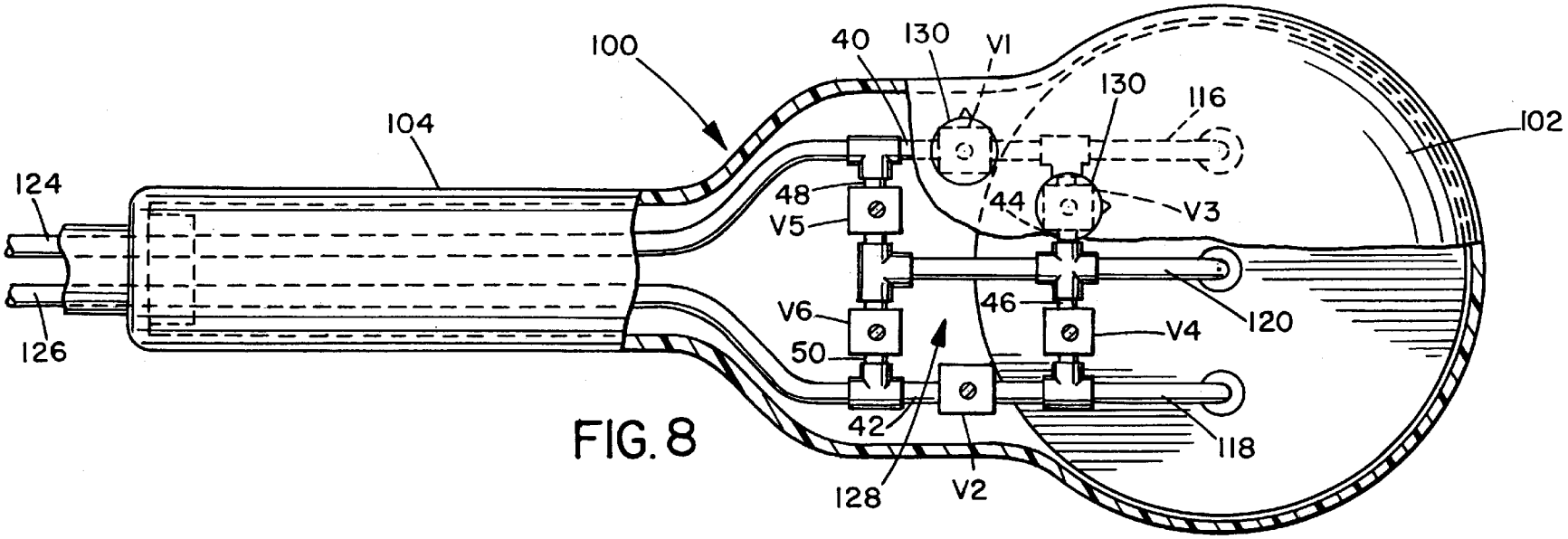
FIG. 8 is a top view, partially cut away, of a hand held configuration of the shower head according to a second embodiment of the invention.

FIGS. 6 and 7 illustrate how a conventional piping system as in FIG. 5 may be modified to provide the separate hot and cold supplies as required for shower head 10. This is accomplished by replacing valves 65 and 69 with valve inserts 75 and 76, respectively, which are illustrated in more detail in FIG. 7. Each insert prevents any water from entering pipe 66 and 67, respectively, and connects the cold supply or hot supply, respectively, to internal passageways 78, 79, respectively, of the valve inserts. Each valve insert 75, 76 comprises a pipe with external threads for threaded engagement in the valve fitting, and has a rubber gasket 77 at one end for seating against the existing valve seat, as illustrated in FIG. 7, cutting off water flow into passages 66 and 67 and directing flow into the respective passageways 78 and 79.

Each valve insert is connected to a T-junction 80, 81 by which it is connected to a tap outlet valve V7, V8, respectively, and to a pipe 85, 86, respectively. The first valve V1 of valve assembly 38 is located in pipe 85, and the second valve V2 is located in pipe 86. The outlet of valve V1 is connected by pipe 88 to the cold water inlet 16 of housing 12, and the outlet of valve V2 is connected by pipe 90 to the hot water inlet 14. A passageway 91 connects pipe 88 to a junction 92 via valve V3, and passageway 94 connects pipe 90 via valve V4 to the same junction 92. Junction 92 connects to the mixed water inlet 18.

Valves V7 and V8 are opened to provide bath water, while valves V1 and V2 are opened in order to provide water to the shower head. Pipes 88 and 90 are flexible tubes which keep the hot and cold water separated for their individual connection to the hot and cold water inlets of the shower head. Valves V1 to V4 may be adjusted as described in connection with FIGS. 1 and 3 above in order to control temperature at the mixed water nozzles M and the proportions of hot and cold water to the hot and cold water spray nozzles H and C.

The arrangement of FIGS. 6 and 7 allows modification of existing bathroom plumbing to readily accommodate the shower head 10 and provide the necessary separate hot and cold water inputs to the shower head.

Figure 10:
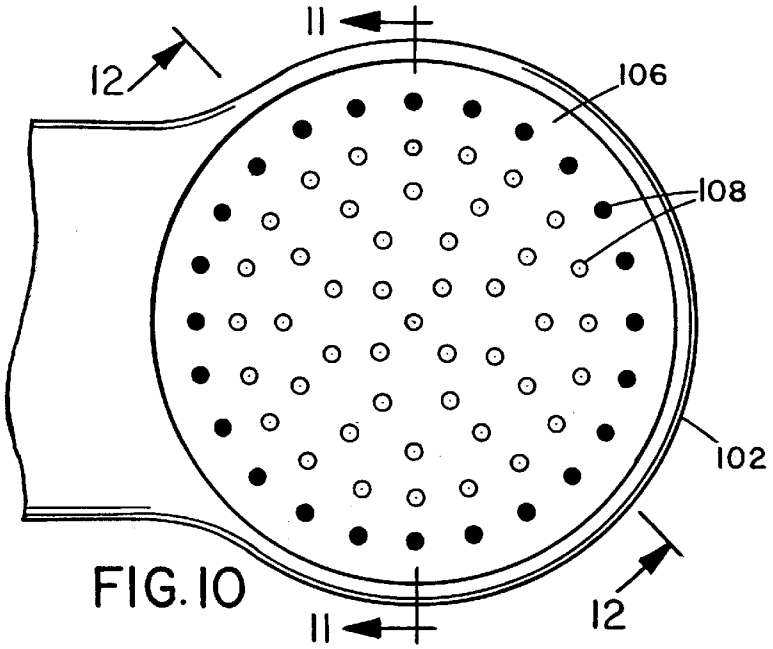
FIG. 10 is a bottom view of the hand held shower head.
Figure 11:
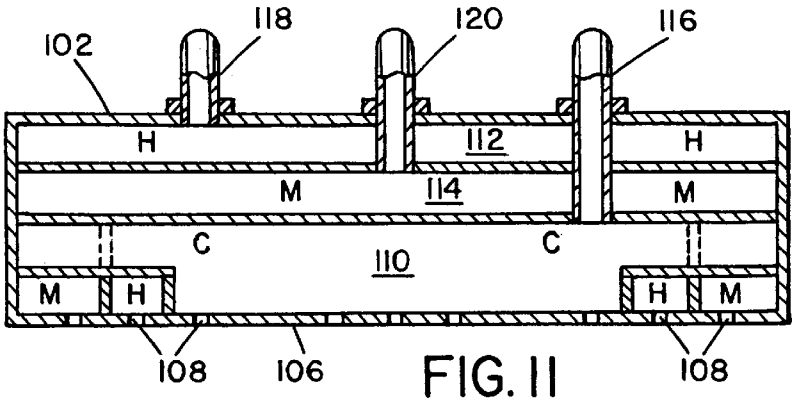
FIG. 11 is an enlarged sectional view taken on line 11—11 of FIG. 10, with the water chambers identified.
Figure 12:
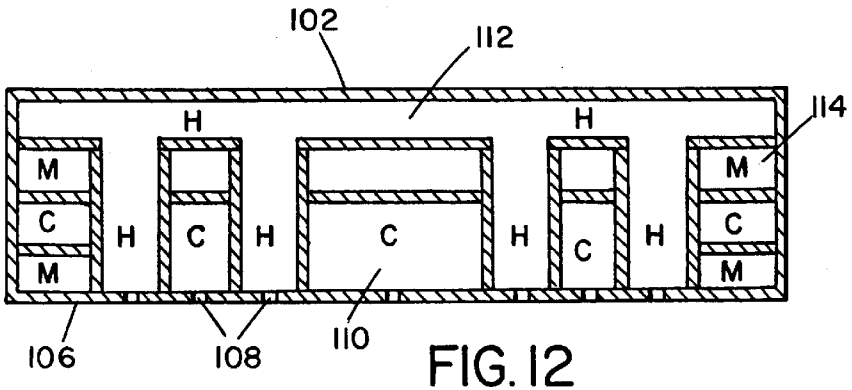
FIG. 12 is an enlarged sectional view taken on line 12—12 of FIG. 10.

FIGS. 8 to 12 illustrate a shower head 100 according to a second embodiment of the invention, which is designed to be hand held if desired, or may alternatively be releasably mounted in a suitable notch in a shower bath fitting, for example. The shower head 100 comprises a generally circular housing 102 with a handle portion 104 extending from the housing. Housing 102 has a flat, outlet face 106 over which a plurality of spray nozzles 108 is arranged in a pattern of concentric circles, as best illustrated in FIG. 10. The outlet face 106 may alternatively be convex or concave.

The housing 102 has three separate internal chambers 110, 112, and 114, each connected to different sets of the spray nozzles 108. The housing has a first, cold water inlet 116 connected to chamber 110, a second, hot water inlet 118 connected to chamber 112, and a third, mixed inlet 120 connected to chamber 114. In a preferred embodiment of the invention, the outermost circle or ring of nozzles 108 (shaded for illustration purposes) are all connected to mixed water chamber 114, and the other rings of nozzles are alternately connected to the hot and cold water chambers 112, 110, respectively. Thus, the arrangement is as follows, starting from the outermost ring of nozzles: ring of mixed water nozzles, ring of hot water nozzles, ring of cold water nozzles, ring of hot water nozzles, innermost ring of cold water nozzles. Any suitable spray nozzles may be used, such as simple orifices as in FIGS. 10 and 11, or adjustable angle spray nozzles as in the previous embodiment.

A pair of flexible hoses 124, 126 extend in through the handle 104 of the shower head and are connected via valve assembly 128 to the inlets 116, 118, 120. Hose 124 is connected to a supply of cold water, while hose 126 is connected to a supply of hot water. The valve assembly is similar to that of FIG. 3, and like references have been used for like valves and passageways as appropriate. As in the previous embodiment, with valves V5 and V6 closed, the shower head operates in hot/cold mode, with hot water supplied to the hot water spray nozzles via passageway 42 and valve V2, cold water supplied to the cold water spray nozzles via passageway 40 and valve V1, and mixed water supplied via passageways 44, 46 and valves V3, V4 to the mixed water nozzles. The proportion of hot and cold water, and thus the water temperature at the mixed outlets, is controlled via valves V1, V2, V3 and V4, as described above in connection with the embodiment of FIGS. 1 to 4. If the user wishes to switch to a completely mixed mode of operation, in which a mixed temperature water is supplied to all of the spray nozzles, valves V1 and V2 are closed, to cut off direct hot and cold water supply to the hot and cold water chambers in the spray head, and valves V5 and V6 are opened to supply the desired water mixture to all of the spray nozzles.

Figure 9:
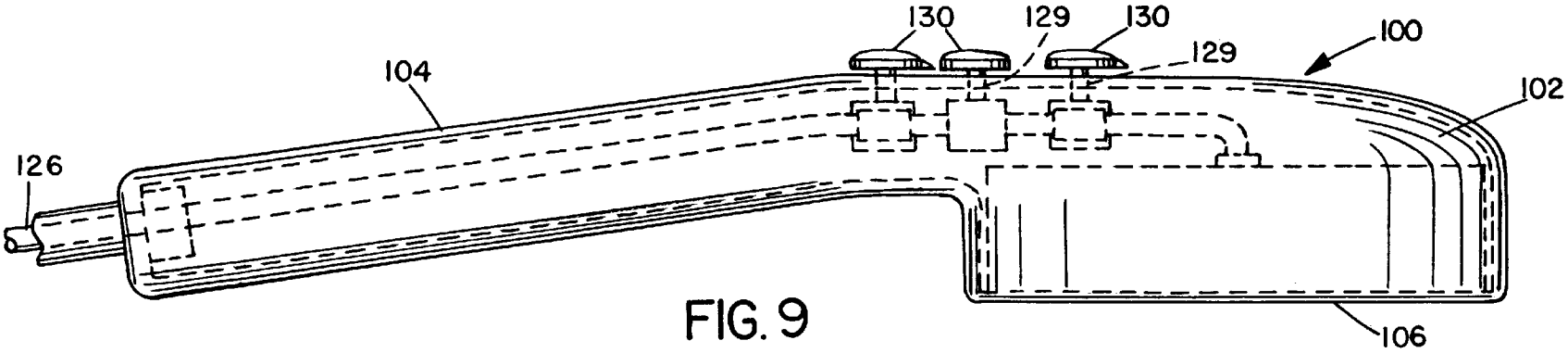
FIG. 9 is a side view of the shower head of FIG. 8.

Each valve has a valve stem 129 extending upwardly through the upper wall of the shower head where it is connected to a control knob 130 for adjusting the valve setting, as illustrated in FIG. 9. Thus, the user can readily switch between hot/cold operating mode and totally mixed operating mode, can adjust the temperature at the mixed spray nozzles, and can adjust the proportions of hot and cold water supplied to the hot and cold spray nozzles.

In this embodiment, a greater number of spray nozzles is provided and the spacing between adjacent nozzles is less than in the first embodiment. The nozzle spacing may be varied, but is preferably in the range from ⅛ inch to 2 inches. The number of nozzles may also be varied, but is preferably in the range from twelve to seventy. In the first embodiment, a total of 36 spray nozzles are provided, with twenty perimeter nozzles at a mixed water temperature, with sixteen internal nozzles (eight hot and eight cold). In the embodiment of FIGS. 8 to 12, a total of 67 nozzles were provided, with 24 mixed nozzles on the perimeter ring, 26 hot water nozzles, and 17 cold water nozzles.

The shower head as described in the above embodiments provides separate hot and cold water spray nozzles to provide the user with the physical sensation of two different temperature sprays, without requiring internal moving parts and therefore reducing the risk of the shower head freezing up or jamming during operation. The shower head can be readily adjusted between different modes of operation, and has an outer perimeter of intermediate or mixed temperature sprays for added comfort when entering the shower.

Although a preferred embodiment of the invention has been described above by way of example only, it will be understood by those skilled in the field that modifications may be made to the disclosed embodiment without departing from the scope of the invention, which is defined by the appended claims.

I claim:

1. A shower head, comprising:

a hollow outer housing having an outlet face, and an array of hot water, mixed water, and cold water nozzles arranged over the outlet face;

a hot water inlet, a mixed water inlet, and a cold water inlet connected to the hot water, mixed water, and cold water nozzles, respectively, for supplying water at a first, hot temperature to the hot water nozzles, at a second, cold temperature to the cold water nozzles, and at a third temperature between the hot and cold water temperatures to said mixed water nozzles; and the hot and cold water nozzles alternating across the outlet face of the shower head.

2. The shower head as claimed in claim 1, wherein the outlet face has an outer periphery and an inner area, the mixed water nozzles are arranged at spaced intervals around the periphery of the outlet face to surround the inner area of the outlet face, and the alternating hot and cold nozzles are located within the inner area surrounded by the mixed water nozzles.

3. The shower head as claimed in claim 1, wherein each spray nozzle provides a very straight, thin spray perpendicular to the outlet face.

4. The shower head as claimed in claim 3, wherein each spray nozzle is adjustable to provide an outlet spray in a range of angles from a straight spray up to a cone-shaped spray which will intersect with adjacent sprays.

5. The shower head as claimed in claim 4, wherein each spray nozzle is adjustable to provide an outlet spray in a range of angles from 0° to 15°.

6. The shower head as claimed in claim 1, including a valve assembly having a first inlet passageway for connection to a cold water supply, a second inlet passageway for connection to a hot water supply, the first inlet passageway being connected to the cold water inlet, and the second inlet passageway being connected to the hot water inlet, the valve assembly further comprising a first valve in the first inlet passageway for controlling cold water supply to the cold water inlet and a second valve in the second inlet passageway for controlling hot water supply to the hot water inlet.

7. The shower head as claimed in claim 6, wherein the housing has a mixed water inlet, and the valve assembly includes third and fourth passageways connecting the first and second passageways to the mixed water inlet, and third and fourth valves in the third and fourth passageways for controlling the mixture of hot and cold water supplied to the mixed water inlet.

8. The shower head as claimed in claim 7, wherein the valve assembly includes fifth and sixth passageways connecting the hot and cold water supplies, respectively, to the mixed water inlet, and fifth and sixth valves, located in the fifth and sixth passageway, respectively, for selectively supplying a mixture of hot and cold water to the hot and cold spray nozzles.

9. A shower head for spraying water in a plurality of streams, comprising:

a hollow outer housing having an outlet face;

a plurality of spray nozzles spaced over the outlet face, the nozzles comprising a first set of cold water nozzles for supplying a water spray at a first temperature, a second set of hot water nozzles for supplying a water spray at a second temperature higher than the first temperature, and a third set of mixed water nozzles for supplying water at a third temperature between the first and second temperatures;

the housing having a first inlet connected to said cold water nozzles, a second inlet connected to said hot water nozzles, and a third inlet connected to said mixed water nozzles;

a cold water supply connected to said first inlet;

a hot water supply connected to said second inlet; and a valve assembly connected between said cold and hot water supplies and said third inlet for supplying a mixture of hot and cold water to said third inlet.

10. The shower head as claimed in claim 9, wherein the outlet face has a perimeter and the third set of nozzles are arranged around the perimeter of the outlet face.

11. The shower head as claimed in claim 10, wherein the hot and cold nozzles are arranged in an area enclosed by the third set of nozzles.

12. The shower head as claimed in claim 11, wherein the hot and cold nozzles alternate across said area.

13. The shower head as claimed in claim 9, wherein said valve assembly includes a valve means for selectively supplying a mixture of hot and cold water to said first and second inlets.

14. The shower head as claimed in claim 9, wherein each nozzle is adjustable to provide a spray over a selected range of angles.

15. The shower head as claimed in claim 9, wherein said housing has an integral handle for gripping by a user when showering.

* * * * *